United States Patent [19]

Alaminos

[11] 4,122,951

[45] Oct. 31, 1978

[54] MACHINE FOR THE AUTOMATIC DETECTION OF BLEMISHES IN OLIVES AND OTHER FRUITS

[76] Inventor: Jose I. L. Alaminos, Avda. Manuel Siurot No. 3, Sevilla, Spain

[21] Appl. No.: 772,988

[22] Filed: Feb. 28, 1977

[51] Int. Cl.[2] ..... B07C 5/344

[52] U.S. Cl. ..... 209/545; 209/587; 209/939

[58] Field of Search ..... 209/111.5, 111.6, 111.7 R, 209/73, 74; 221/265

[56] References Cited

U.S. PATENT DOCUMENTS

| | | | |
|---|---|---|---|
| 2,742,184 | 4/1956 | Yerkes et al. | 221/265 X |
| 2,798,605 | 7/1957 | Richards | 209/111.5 |
| 3,380,586 | 4/1968 | Frobese et al. | 209/111.6 X |
| 3,429,437 | 2/1969 | Terschanski et al. | 209/111.5 |
| 3,768,645 | 10/1973 | Conway et al. | 209/111.5 |
| 3,773,172 | 11/1973 | McClure et al. | 209/111.6 |

*Primary Examiner*—Allen N. Knowles
*Attorney, Agent, or Firm*—Mason, Kolehmainen, Rathburn & Wyss

[57] ABSTRACT

The present invention relates to a machine that is capable, by itself alone, of detecting blemishes in olives and similar products, and subsequently to select the said products on the basis of the size of their possible blemishes. For this purpose the machine in question makes use of a television camera that supplies the corresponding video signal to an electronic unit which performs the operation of selection.

7 Claims, 10 Drawing Figures

MACHINE FOR THE AUTOMATIC DETECTION OF BLEMISHES IN OLIVES AND OTHER FRUITS

The present invention refers to a machine for the automatic detection of blemishes in olives and other fruits, the purpose of which is to provide the producers of such fruits with a machine that is capable, by itself alone, of detecting blemishes in olives and similar products, and subsequently to select the said products on the basis of the size of their possible blemishes. For this purpose the machine in question makes use of a standard television camera that supplies the corresponding video signal to an electronic unit which performs the operation of selection.

With the said machine, the subject of the invention, the saving in labour is evident, since the selection of olives and similar products has been carried out up to the present time by visual inspection of the said products with the resulting slowness, since the person encharged with the visual inspection must, as is logical, turn the olives to see their possible blemishes, and in the event that such olives are turned by mechanical means, their passage must be very slow so that the person or persons encharged with the selection may have time to carry out the latter.

The machine in question consists of a feed device for olives constituted by a reception hopper, the feed complex itself, and a transporter element, in such a way that the hopper maintains a constant level of olives in the receptacle of the feed complex, which is provided with a rotary disc having 16 radial rows, each of 8 orifices, the olives being deposited unit by unit in each one of the above-mentioned orifices, which operation is effected on the disc turning. Provision has been made in the base of the receptacle for orifices in alignment through which the olives pass on each radial line of the rotary disc coinciding with the above-mentioned alignment of orifices in the base, so that the olives thus fall into lanes determined by rollers that are in continuous movement, being driven by an endless belt.

The olives aligned in the said lanes and transported by the endless belt equipped with rollers pass through a zone termed the observation zone, where the television camera has been installed, and which provides exact information in the video signal regarding the existence of blemishes or not, and the size and form of any such blemishes.

The extraction of this information from the video signal is possible by means of electronic processing of the said signal, in such a manner that on the basis of the information provided by the signal obtained, and by means of external controls, the system provides the electrical signals necessary for the functioning of the electro-mechanical systems whose mission is that of affecting the classification envisaged.

In the event of a blemish existing, and on the above-mentioned electro-mechanical systems being operated, these systems cause the blemished olives to be expelled or directed to a collection bin different from that into which the unblemished olives fall. This operation can be carried out in two ways, either by suction of air or by a jet of compressed air.

In order to complement the description given in what follows and in order to aid a better understanding of the characteristics of the invention, this descriptive memorandum is accompanied by a set of drawings whose figures represent the following:

Figure 1:
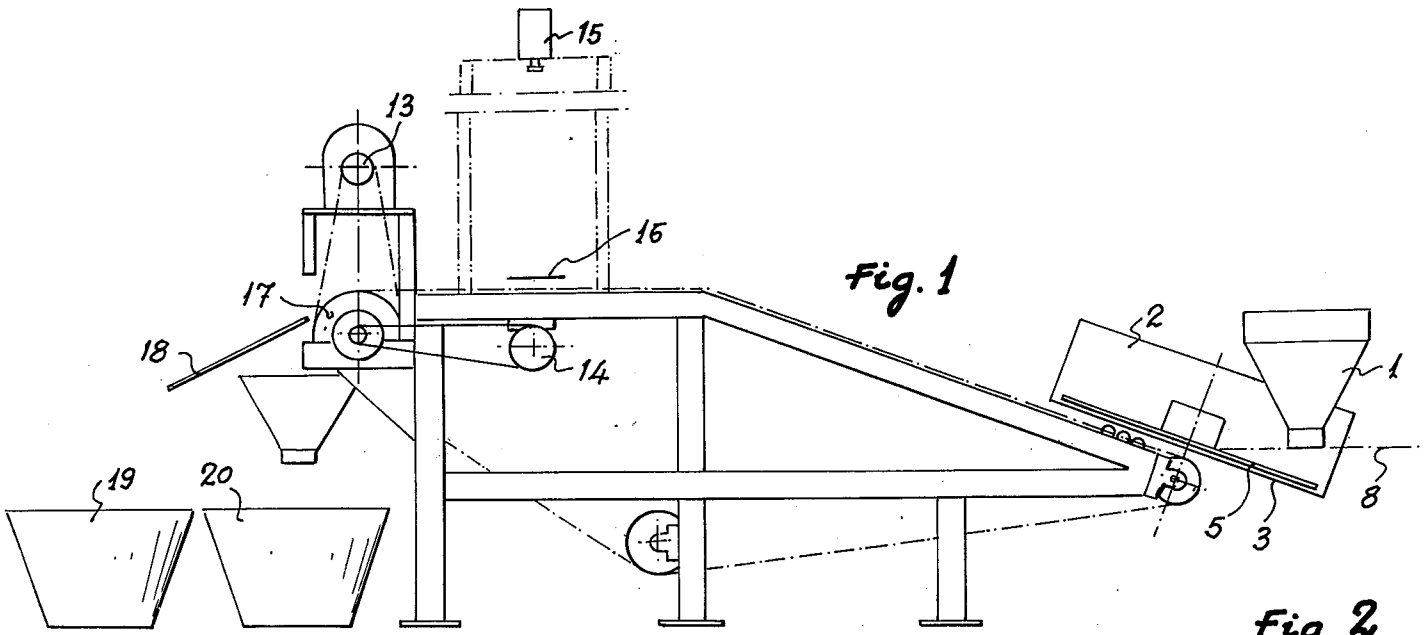
FIG. 1 shows a lateral elevation view of the machine, with the television camera in a zone higher than the machine.
Figure 2:
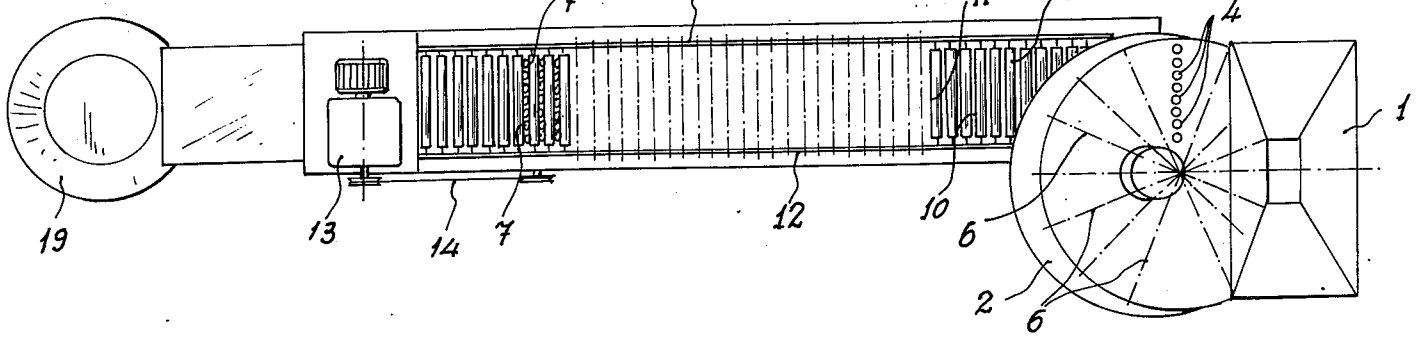
FIG. 2 shows an upper plan view of the machine.

On studying the figures there may be observed the reception hopper for olives 1, which by means of the inclined position of the feed receptacle 2 maintains a constant level 8 of olives in the said feed receptacle 2: the latter presents, near its base 3 a rotary disc 5 equipped with 16 radial rows 6 each of which has 8 orifices. On each row or alignment of orifices 4 passing through the lowest zone of the receptacle 2, an olive is inserted into each orifice, the olives being transported in the course of rotation of the disc 5 to the place in the base or bottom 3 where a further eight orifices 4 have been made. The olives 7 fall through these latter orifices to the lanes 11 determined by the rollers 9 and longitudinal dividing elements 10. The said rollers 9 are fixed by their ends to lateral bands 12, thus constituting an endless belt which, by means of the drive of the motor 13 is continuously in movement and transporting olives 7 from the lower part of the receptacle 2 to the zone of observation 16, where there has been appropriately situated a television camera 15 which monitors the whole of the surface of the olives, thanks to the fact that in the said zone 16 the rollers 9 turn on their own axis, a movement or turning which is achieved by means of a pulley device 14, which rubs against the surface of the said rollers in a direction opposite to that of their movement, and causes them to turn so that the olives 7 rotate so that the whole of their surface may be observed.

Again, so that the olives 7 may fall from the rotary disc 5 to the line of orifices 4 of the base 3 of the feed receptacle 2 in a coincident manner into the lanes 11, it is necessary that the said rotary disc be synchronized in its movement with the advance of the rollers 9.

Figure 3:
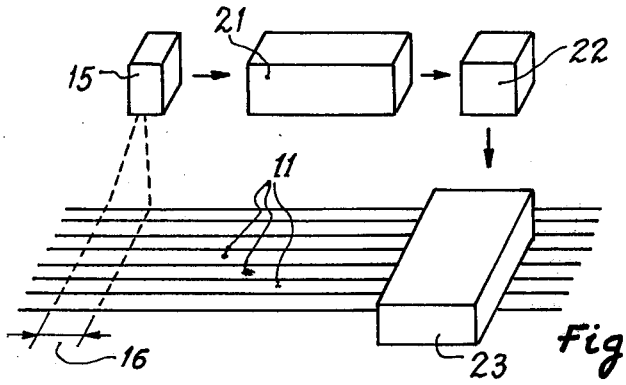
FIG. 3 shows a block diagram representing the stages followed in the detection and classification of blemishes in the olives.
Figure 4:
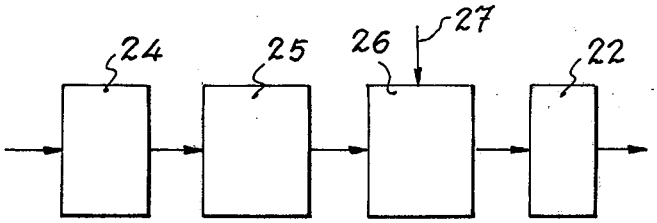
FIG. 4 shows a block diagram corresponding to the electronic system employed to effect the detection and classification.

Once the olives 7 are situated in the observation zone 16, there enters into operation the electronic complex for the detection and classification of the said olives. FIG. 3 shows the corresponding theoretical block diagram in which the following steps may be appreciated:

(a) the fruit or olive 7 under study provides, by means of the television camera 15 precise information in the video signal concerning the existence or not of blemishes, and the nature of such blemishes together with their size and form.

(b) the extraction of this information from the video signal is possible by means of electronic processing which is effected in the electronic unit 21 so that the latter may send the necessary corresponding signals to the expulsion system 23. This process may be effected simultaneously through various channels.

FIG. 1 shows the block diagram of the electronic complex that carried out the process of automatic detection of blemishes in the olives 7 or other similar products, in such a way that the video signal is sent to an input unit 24, from which it passes to the corresponding detection unit 25 which sends the information to a digital processing unit 26; by means of external controls 27 the system provides the electrical signals necessary for the functioning of the electro mechanical systems which have the mission of effecting the classification, and in this way the said signals are sent to the expulsion system 23 which counts with an expulsion device 17, it being possible to effect the expulsion in either of two forms:

(1) By vacuum suction (2) By expulsion by means of a jet of compressed air.

In both cases the electrical signal operates an electrovalve that opens the vacuum piping or the compressed air outlet, respectively.

Figure 5:
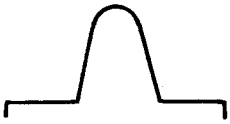
FIGS. 5 and 6 represent the video signals produced by a sound olive and a blemished olive respectively.
Figure 6:
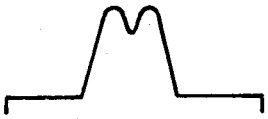

FIGS. 5 and 6 show the form of the video signals produced by a sound olive and by a blemished olive respectively.

The detection of the blemish is effected in accordance with the following sequence of operations:

a. Amplification and filtering of the signal.

b. Branching off and amplification of the signal branched.

c. Comparison of the signal obtained with a column of N levels.

d. Digital processing.

In the said digital processing there intervene various external controls, which are: a selector of amplitude of the field of observation in two dimensions (transverse and longitudinal), a selector of blemish size, and a selector of the number of channels into which the field is divided for the simultaneous processing of various olives.

The whole of the electronic system is complemented by an output unit 22 which synchronizes the passage of the rows of olives under the cameras with the detectors and with the expulsion systems.

When the olives 7 have been detected and classified in accordance with their blemishes, the expulsion device 17 diverts them towards a fall ramp 18 that direct them to the collection container 19 for defective olives. The unblemished olives fall directly into the corresponding collection container 10 for unblemished olives.

Another of the prefered forms of implementation of the invention presents a variant with respect to the device that feeds the roller transporter unit, which consists in fitting these rollers with a series of separating projecting elements which substitute the dividing elements existing in the previous version together with a device for limiting the fruit transported. This variant form is shown in FIGS. 7, 8, 9 and 10.

Figure 7:
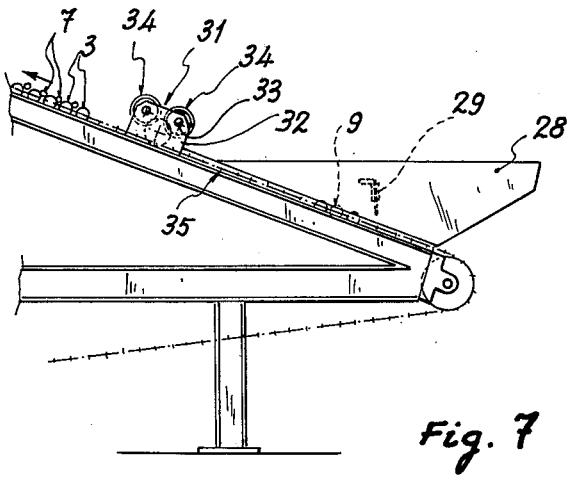

FIG. 7 shows a lateral elevation view of the part of the machine that shows the loading end.

Figure 8:
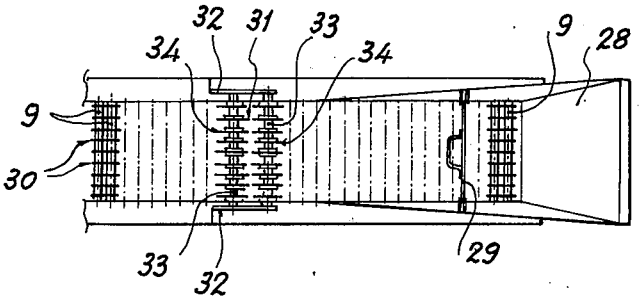

FIG. 8 corresponds to a plan view of the foregoing.

Figure 9:
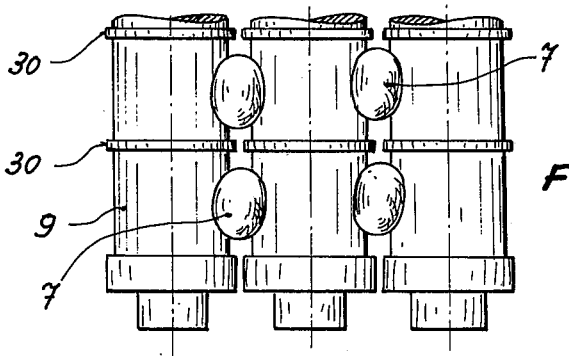

FIG. 9 shows a plan view of a detail of the rollers.

Figure 10:
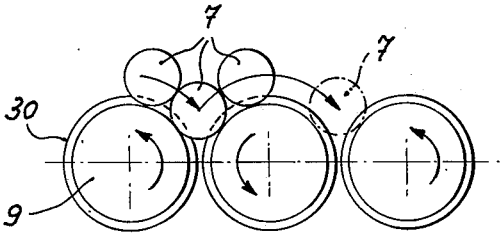

FIG. 10 shows an elevation view of the said rollers, in which there may be seen the turning undergone by the olives in relation to the rotation of the said rollers.

In accordance with the invention, the feed device includes a loading station 28 formed by a receptacle like a hopper, and in the form of a wedge, with the outlet horizontal, the lower part of which is perfectly adapted to the roller transporter 30 so that on pouring the olives or fruit to be classified they are deposited on the said transporter, the loading capacity being limited by a gate 29 which can control a lower passage opening.

Each of the rollers 30 is fitted with a series of equidistant annular projecting elements 31, so that a division of lanes in an adequate quantity is established; thus each roller 30 loads a number of olives or pieces of fruit equal to that of the inspection elements included in the electronic system.

A particularly important characteristic consists of the fact that the rollers, during their travel along the inclined plane 37 of the machine are endowed with a movement of rotation in the direction of travel, as has been indicated in FIG. 10, so that the olives 32 deposited in bulk in the first section of the loading station 28 will proceed by turning over until they are arranged in a single row between every two rollers 30 each one occupying the space limited by the annular projecting elements 31.

At the outlet of the loading station 28 and still on the ramp or inclined plane 37, provision is made for a regulating station 33 constituted by two lateral walls 34 facing one another on which there rest at least two shafts 35 which carry a series of rubber discs 36 so that they will limit the passage of the olives 32 so that there can never be introduced into a lane established by annular projecting elements 31 more than one row of olives, so that the latter will reach the observation zone (not represented) in optimum conditions.

What is claimed is:

1. A machine for the automatic detection of blemishes in olives and other fruits, comprising: a hopper for the reception of the fruit, feed apparatus supplied by said hopper and including a container having a base with a line of orifices said feed apparatus including a rotary disc containing radial rows of orifices on which the olives are deposited in such a manner that with rotation of said disc each of the rows upon alignment with the row of orifices in said base allows the olives or pieces of fruit to fall therethrough, an endless belt constituted by a series of rollers that present a series of longitudinal lanes formed by dividing elements, the olives falling upon said belt and being transported to an observation zone, a television camera situated at the observation zone, means for causing the rollers to turn when they advance through the said zone, electronic means responsive to said television camera for transforming the video signal obtained with the television camera into an electrical signal, means responsive to said electronic means for the expulsion of the blemished fruit or olives, said expulsion means causing said blemished olives to be directed to a container different from that for the collection of unblemished olives.

2. A machine for the automatic detection of blemishes in olives and other fruits, in accordance with claim 1, essentially characterized in that the detection of the blemishes is effected by said electronic means which comprises means for amplification and filtering of the signal, means responsive to said amplification means for differentiating said signal means responsive to said differentiating means for comparing said signal with a column of N levels, means responsive to said comparing means and predetermined external control signals for modifying said signal and outputting said signal to a digital processing unit, said external control signals including a selector of the amplitude of the field of observation, a selector of the size of the blemish and a selector of the number of channels into which the said field is divided for the purpose of the simultaneous processing of various olives, and an output unit that synchronizes the passage of the rows of olives under the camera with the detectors and with the systems of expulsion.

3. A machine for the automatic detection of blemishes in olives and other fruits, in accordance with claim 1, essentially characterized in that said expulsion means can be constituted in such a way as to act by means of air pressure variation, said electrical signal controlling said expulsion means.

4. A machine for the automatic detection of blemishes in olives and other fruits, in accordance with claim No. 1, characterized in that at the outlet of the loading station there is situated an inclined plane a regulating station constituted by rollers, appropriately supported, situated above the transporter, and fitted with a series of rubber discs that limit the passage of olives so that the rows of olives pass in an orderly manner.

5. A machine for the automatic detection of blemishes in olives, comprising: a hopper of pyramidal frustum shape without base, for the reception of the olives arranged in the part of said hopper corresponding to the bigger base upwards whereby the olives enter in bulk and leave by the part of said hopper that would correspond to the lower base, a side aperture in the side of said hopper; an endless conveying belt situated and adjusted underneath said hopper including rollers having protruding equidistant annular elements provided with a rotation movement performed by friction; bars disposed adjacent the belt for contacting said annular elements, the olives leaving the hopper and being deposited in a disorderly manner and in bulk on the conveying rollers, the olives turning in response to said rotational movement, and orientated with their biggest shaft parallel to the shaft of the conveying rollers and arranged in a single row between two rollers and each olive occupying the space limited by the annular projecting elements; a television camera situated at a zone of observation; electronic means responsive to said television camera for transforming the video signal obtained with the television camera; expulsion means responsive to said electronic means for expulsion of the olives with blemishes, said expulsion means directing the blemished olives to a different recipient from that of picking the unblemished olives.

6. Machine for the automatic detection of blemishes in olives, according to claim 5, wherein said electronic means comprises means for differentiating part of each video line of said video signal, said part selected by a key impulse which displaces with the same velocity as the conveying belt of the conveying rollers, the derived function analysed by an array of comparators that determine the amplitude and extent of color of the blemish converting said signal to digital format, said digital signals evaluating the width as well as the length of said blemish; said expulsion means comprising control means responsive to said digital signals and including up-down counters for controlling the expulsion order of the olive, and the machine further comprising an exit unit that syncronizes the passage of the rows of olives under the camera with said expulsion means.

7. Machine for the automatic detection of blemishes in olives, according to claim 5, essentially characterized in that said expulsion means includes means for generating a jet of compressed air coming from a motor-compressor and responsive to said digital signal.

* * * * *